US005651680A

United States Patent [19]

Levy

[11] Patent Number: 5,651,680

[45] Date of Patent: Jul. 29, 1997

[54] GOLF TRAINING DEVICE

[76] Inventor: Carey Levy, 28062 Hastings, Mission Viejo, Calif. 92692

[21] Appl. No.: 596,989

[22] Filed: Feb. 5, 1996

[51] Int. Cl.[6] ..... A63B 69/36

[52] U.S. Cl. ..... 434/252; 473/208

[58] Field of Search ..... 473/207, 208, 473/211, 215, 274, 275; 273/190 R, 190 A, 190 B, 189 R; 434/252; 128/859, 861, 862

[56] References Cited

U.S. PATENT DOCUMENTS

| | | | |
|---|---|---|---|
| 1,126,051 | 1/1915 | McGillicuddy | 473/208 |
| 3,109,654 | 11/1963 | Comitz | 273/183 |
| 3,804,420 | 4/1974 | Boyd | 273/183 B |
| 3,860,246 | 1/1975 | Fish | 273/183 B |
| 3,951,414 | 4/1976 | Nunez | 273/183 B |
| 4,936,584 | 6/1990 | Ewald et al. | 273/183 B |
| 5,174,564 | 12/1992 | Young, III | 472/208 X |

FOREIGN PATENT DOCUMENTS

| | | | |
|---|---|---|---|
| 2236530 | 2/1975 | France | 273/190 B |

*Primary Examiner*—Jeffrey A. Smith
*Attorney, Agent, or Firm*—Goldstein & Associates

[57] ABSTRACT

A golf training system for conditioning a golfer to keep his head down and straight during a full golf swing by alerting the golfer after the execution of each swing whether said previous swing was performed properly, comprising a cord, said cord having a proximal end and a distal end, a mouthpiece, said mouthpiece secured at the proximal end of said cord, and a fastening assembly, said fastening assembly secured to the distal end of the cord. The mouthpiece is grasped within the mouth of the golfer, and the fastening assembly then secured to an article of the golfer's clothing such that the cord located between said fastening assembly and the mouthpiece is semi-taught when the golfer's head is fixed in a straight, downward position. After execution of the swing, if the fastening assembly has disengaged the golfer's clothing, the golfer is alerted that the execution of his swing was faulty in that he improperly lifted or turned his head.

3 Claims, 3 Drawing Sheets

GOLF TRAINING DEVICE

BACKGROUND OF THE INVENTION

The invention relates to a golf training system. More particularly, the invention is directed towards an a system which passively teaches a golfer how to avoid lifting or turning his head during a full golf swing (the term "full" swing is used throughout to define a swing undertaken while propelling the golf ball with a wood or iron, as opposed to propelling the ball with a putter). Enthusiasts as well as professional instructors of the game of golf unanimously agree that one of the most pressing problems faced in mastering the game is the ability to keep one's head down and straight during a full golf swing.

By maintaining a straight and downward tilt of the head, the golfer is able to focus upon the ball, execute a smooth and even swing, and complete the full suppination of the wrists necessary to get off a crisp, straight golf shot. If the head is improperly lifted, as is often the case, every element in the execution of the swing is faulty, and a poor shot results.

While various references uncovered in the art attempt to provide training devices and aides intended to help a golfer keep his head down and straight during the golf swing, no device has heretofore been developed which performs this task effectively or safely. U.S. Pat. No. 3,109,654 to Comitz, for example, discloses a golf cap having a weighted fishing sinker-type device suspended from a cord which is affixed to the brim of the cap. The weighted device is intended to help the golfer maintain a straight, downward tilt of the head during the swing, and is also designed to act as an indicating means by striking the golfer in the face in the event that he fails to maintain said tilt. This device is ineffective in that it only signals the golfer if he deviates from a straight head tilt. It fails to signal the golfer if he improperly lifts his head, since the vertical alignment of the weight and cord would not change if the golfer lifts or raises his head directly upward. The vertical alignment of the weight-cord assembly would tend to only indicate improper lateral movement by the golfer.

Furthermore, said device is cumbersome and annoying in that it requires the golfer to wear a cap, and tends to visually obstruct the golfer's vision due to the fact that the weighted device is suspended immediately before the golfer's eye. The Comitz device is also dangerous, since the weighted device might strike the golfer in the eye, as it is suspended directly in front thereof.

U.S. Pat. No. 3,860,246 to Fish discloses a device similar to that contemplated in Comitz, in that a weighted cord is employed in an attempt to help a golfer maintain a straight, downward tilt of the head during the golf swing. A weighted plumb-bob is suspended from a cord which is grasped, via a mouthpiece, in the golfer's mouth. The weighted plumb-bob is to be suspended over the center of the golf ball prior to addressing said ball, to assist the golfer in maintaining his head over the ball. As was the case with the Comitz device, this device too fails to signal the golfer if he improperly lifts his head, since the vertical alignment of the weight and cord would not change if the golfer lifts or raises his head directly upward. Furthermore, this device is even more dangerous than the Comitz apparatus, since a misguided swing by the golfer might inadvertently contact the plumb-bob weight, causing injury to the golfer himself or others around him.

The primary defect in the Comitz and Fish patents as well as other active teaching aides in the field is that these devices do not teach the golfer how to swing correctly when not utilizing these devices. A passive teaching device-one which does not prevent the golfer from improperly swinging, but only indicates that an improper swing has been executed after the fact—is what is needed in the field. What is needed is a device which, rather than causing the golfer to focus on dangerous weighted devices dangling before his eyes or feet, allows the golfer to concentrate on his swing and then check the correctness of said swing after its completion.

While these units mentioned above may be suitable for the particular purpose employed, or for general use, they would not be as suitable for the purposes of the present invention as disclosed hereafter.

SUMMARY OF THE INVENTION

It is an object of the invention to produce a golf training device which is simple and inexpensive in construction, and may be transported and used by a golfer with great ease by simply being fastened to the golfer's shirt.

It is another object of the invention to provide a golf training device which is capable of passively training a golfer to keep his head in a straight, downward position during execution of a full golf swing, by alerting the golfer after said swing is completed if the golfer performed any improper lateral or vertical movements of his head during the swing.

It is a further object of the invention to provide a golf training device which may be used safely by a golfer, posing no threat of injury to the golfer or those in the immediate area surrounding him.

The invention is a golf training system for conditioning a golfer to keep his head down and straight during a full golf swing by alerting the golfer after the execution of each swing whether said previous swing was performed properly, comprising a cord, said cord having a proximal end and a distal end, a mouthpiece, said mouthpiece secured at the proximal end of said cord, and a fastening assembly, said fastening assembly secured to the distal end of the cord. The mouthpiece is grasped within the mouth of the golfer, and the fastening assembly then secured to an article of the golfer's clothing such that the cord located between said fastening assembly and the mouthpiece is semi-taught when the golfer's head is fixed in a straight, downward position. After execution of the swing, if the fastening assembly has disengaged the golfer's clothing, the golfer is alerted that the execution of his swing was faulty in that he improperly lifted or turned his head.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
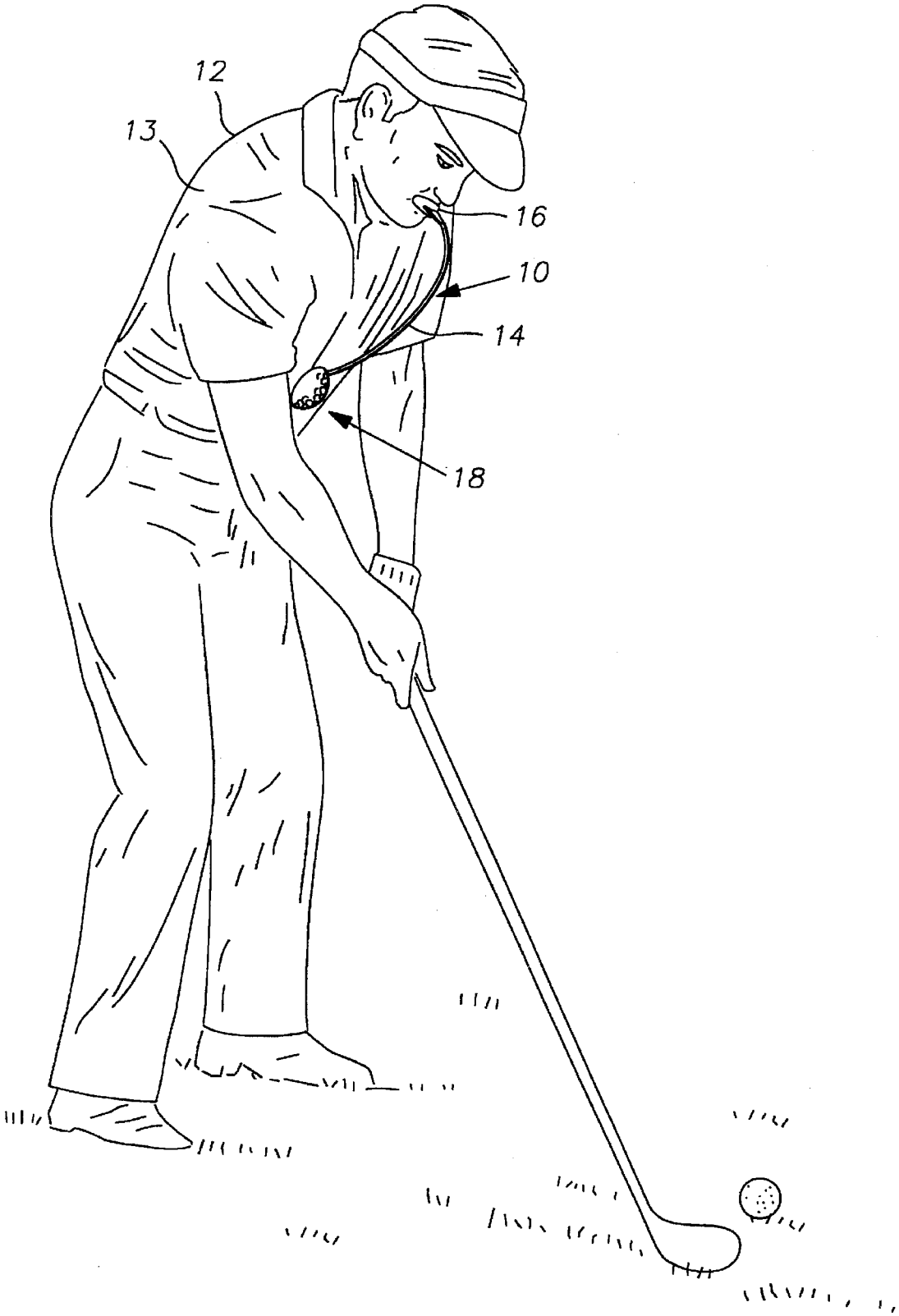
FIG. 1 is a diagrammatic perspective view of the instant invention being used by a golfer.
Figure 2:
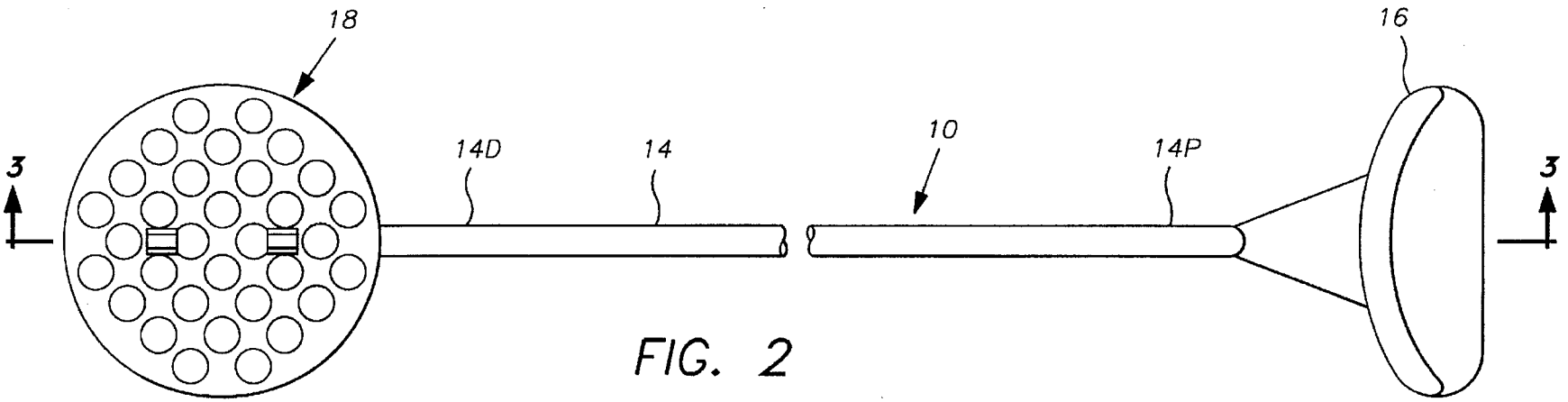
FIG. 2 is a top plan view of the instant invention.
Figure 3:
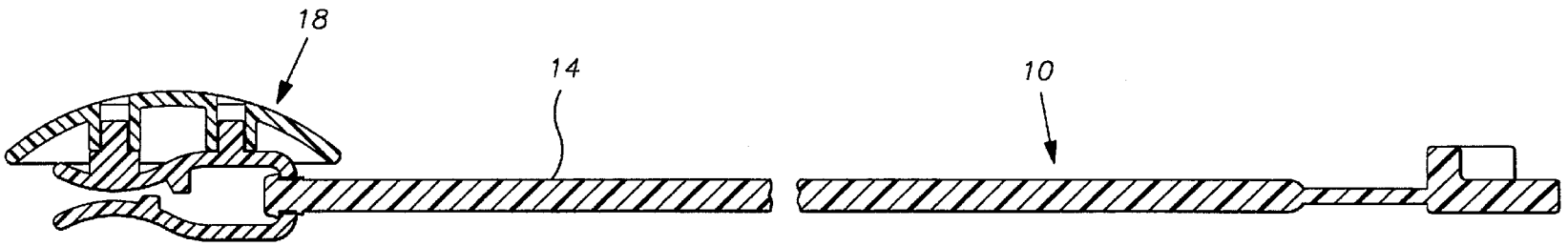
FIG. 3 is a cross-sectional view, taken on line 3—3 of FIG. 2, of the instant invention.

FIG. 1 illustrates a golf training device 10 being used by a golfer 12. In FIG. 2, it can be seen that the golf training device 10 comprises a cord 14, having a proximal end 14P and a distal end 14D. The cord 14 should be sufficiently flexible so that it may bend freely, but should not be so pliable that it is capable of stretching or deforming. A mouthpiece 16 is permanently secured to the proximal end 14P of the cord 14, said mouthpiece 16 having a slight curvature such that the shape of said mouthpiece 16 corresponds to the natural shape of and may be grasped within the mouth of a typical golfer 12.

Figure 5:
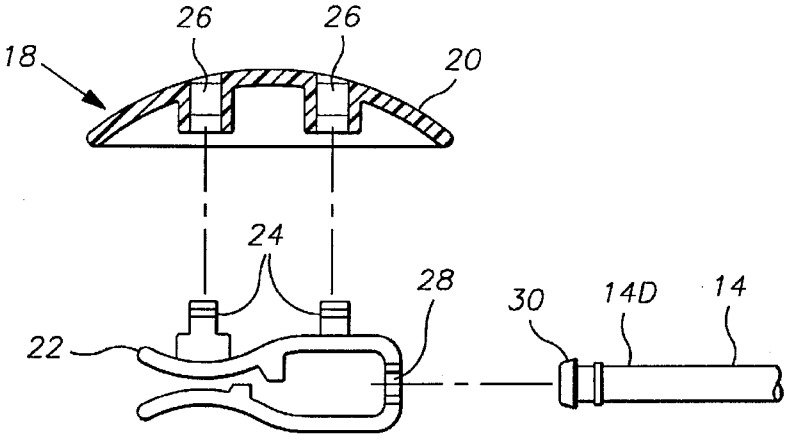
FIG. 5 is an exploded view of the portion of the instant invention which was depicted in FIG. 4.

A fastening assembly 18 is secured to the distal end 14D of the cord 14, as illustrated in FIGS. 2,3,4 and 5. FIG. 5 best illustrates the details of the fastening assembly 18. There it can be seen that the fastening assembly 18 essentially comprises an attachment means with an attachment means cover 20 located thereon. The attachment means can comprise any type of clip such as a spring clip, jam Clip, pressure clip or the like. The embodiment of the instant invention which is depicted in FIG. 5 illustrates the employment of a pressure clip 22. Locking tabs 24 extend upward from the attachment means. Locking tab indents 26 are located upon the attachment means cover 20. Said locking tab indents 26 correspond in size to the locking tabs 24, so that the locking tabs 24 may be inserted therein to removeably secure the attachment means cover 20 to the attachment means. Furthermore, the attachment means cover 20 can be constructed to represent various themes or logos of interest to the golfer 12, such as is depicted in FIG. 2 wherein the attachment means cover depicts the surface of a golf ball.

Figure 4:
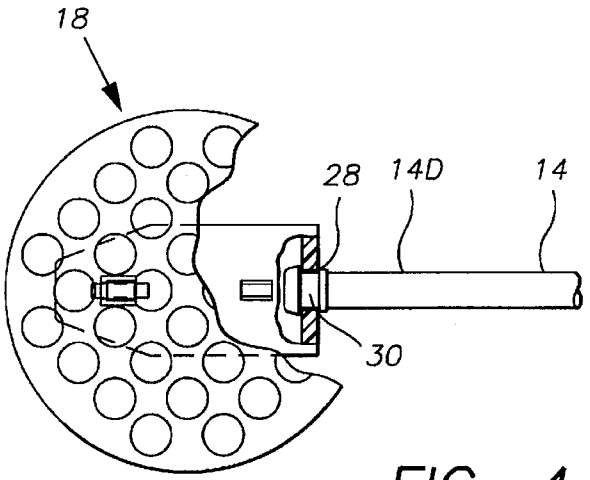
FIG. 4 is an enlarged view of a portion of the instant invention, with parts broken away.
Figure 6:
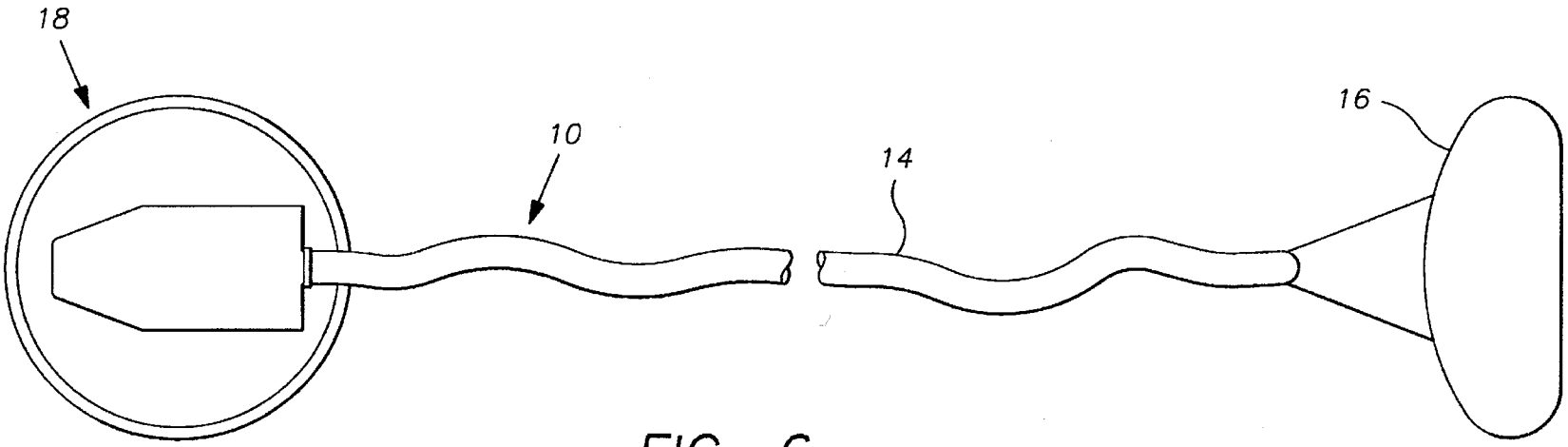
FIG. 6 is a bottom plan view of the instant invention.

Reference again to FIG. 5 illustrates a nipple aperture 28, which is located upon the pressure clip 22 or whichever type of attachment means are employed. A nipple 30 located at the distal end 14D of the cord 14 is capable of being inserted within said nipple aperture 28 and being retained semi-permanently therein, as shown in FIG. 4. Once the golf training device 10 is fully assembled, it appears as depicted in FIGS. 2 and 6.

FIG. 1 shows the golf training device 10 in use. To use the instant invention the golfer 12, who is wearing a shirt 13, secures the fastening assembly 18 of the fully assembled golf training device 10 to the shirt 13 (or any other suitable article of clothing) at a location such that upon the golfer 12 putting the mouthpiece 14 into his mouth, the cord 14 located between said mouthpiece 16 and fastening assembly 18 is semi-taught when the golfer's 12 head is tilted straight downward. The fastening assembly 18 of the golf training device 10 is secured to the shirt by causing the attachment means such as the pressure clip 22 shown in FIG. 5 to grasp a small amount of the material which comprises the shirt 13. Once the fastening assembly 18 is secured to the shirt 13 of the golfer 12 and the mouthpiece 16 is contained within the mouth of the golfer 12, any improper lateral or vertical movement of the head of the golfer 12 will cause the semi-taught cord 14 to disengage the fastening assembly 18 from the article of the golfer's clothing to which it was previously secured. Upon seeing that the fastening assembly 18 has separated from the golfer's clothing, the golfer 12 will be alerted that he executed a faulty golf swing in that he improperly lifted or turned his head. The golfer 12 may then take appropriate steps to correct his behavior during execution of the next golf swing.

What is claimed is:

1. A golf training device for conditioning a golfer to keep his head down and straight during a full golf swing, comprising:

a) a cord, said cord having a proximal end, a distal end and a nipple, said nipple protruding from the distal end of the cord;

b) a mouthpiece, said mouthpiece secured at the proximal end of the cord;

c) a fastening assembly, said fastening assembly having a nipple aperture located thereon, the nipple located at the distal end of the cord and being removably inserted and contained within said nipple aperture thus detachably securing the distal end of the cord to the fastening assembly, the fastening assembly further comprising an attachment means and an attachment means cover removeably located thereon, said attachment means cover capable of disguising the attachment means.

2. The golf training device of claim 1, wherein locking tabs extend upward from the attachment means, and locking tab indents corresponding in size to said locking tabs are located upon the attachment means cover such that said locking tabs may be received and secured within the locking tab indents, whereby the attachment means cover may be removeably secured to the attachment means.

3. A golf training device for conditioning a golfer to keep his head down and straight during a full golf swing, comprising:

a) a cord of fixed length, said cord having a proximal end and a distal end;

b) a mouthpiece, said mouthpiece secured at the proximal end of said cord; and c) a fastening assembly, said fastening assembly detachably secured to the distal end of the cord and further comprising an attachment means and an attachment means cover removeably located thereon, wherein said attachment means cover is capable of disguising said attachment means.

* * * * *